US006971772B1

(12) United States Patent
Abdelsamed et al.

(10) Patent No.: US 6,971,772 B1
(45) Date of Patent: Dec. 6, 2005

(54) LUMINAIRE GLOBES HAVING INTERNAL LIGHT CONTROL ELEMENTS

(75) Inventors: Yaser S. Abdelsamed, Granville, OH (US); Michael Packer, Grandview Heights, OH (US)

(73) Assignee: Acuity Brands, Inc., Atlanta, GA (US)

( * ) Notice: Subject to any disclaimer, the term of this patent is extended or adjusted under 35 U.S.C. 154(b) by 27 days.

(21) Appl. No.: 10/461,190

(22) Filed: Jun. 12, 2003

(51) Int. Cl.[7] ..... F21V 7/00; F21V 3/00

(52) U.S. Cl. ..... 362/309; 362/363; 362/308; 362/328

(58) Field of Search ..... 362/304, 809, 362/363, 186, 309, 299, 301, 302, 297, 308, 362/310, 328, 327

(56) References Cited

U.S. PATENT DOCUMENTS 1,594,042 A * 7/1926 Brueggeman ..... 362/305
2,007,033 A * 7/1935 Williams ..... 362/309
3,278,743 A * 10/1966 Franck ..... 362/297
3,363,092 A * 1/1968 Clark et al. ..... 362/223
4,434,455 A * 2/1984 Merritt ..... 362/310
4,719,548 A * 1/1988 Orosz ..... 362/309
5,481,445 A * 1/1996 Sitzema et al. ..... 362/308
5,743,634 A * 4/1998 Sitzema et al. ..... 362/310
6,027,231 A * 2/2000 Fouke ..... 362/309
6,033,093 A * 3/2000 Latsis et al. ..... 362/304

* cited by examiner

*Primary Examiner*—John Anthony Ward
*Assistant Examiner*—Bao Q. Truong
(74) *Attorney, Agent, or Firm*—Kenneth E. Darnell

(57) ABSTRACT

Luminaire optical assemblies intended for pole-mounted and similar applications and capable of effective I.E.S. cutoff performance while exhibiting desirable light distributions even with vertically oriented lamping, the invention contemplates in primary embodiments light-transmissive reflector/refractor combinations typically formed of glass, acrylics and the like, uplight shielding and reflector assemblies of a variety of configurations being disposed within the reflector/refractor combinations to produce desired cutoff characteristics while preserving daytime appearance during nocturnal operation. In certain embodiments of the invention, uplight is controlled by the several variations of the uplight shielding and reflector assemblies to cause light-transmissive portions of the reflector/refractor combinations to subtly glow and thus produce a desired appearance while also producing cutoff characteristics necessary to reduce urban sky glow and glare. The luminaire optical assemblies further permit achievement of I.E.S. cutoff with vertical tamping while maximizing efficiency.

68 Claims, 13 Drawing Sheets

Fig. 9A
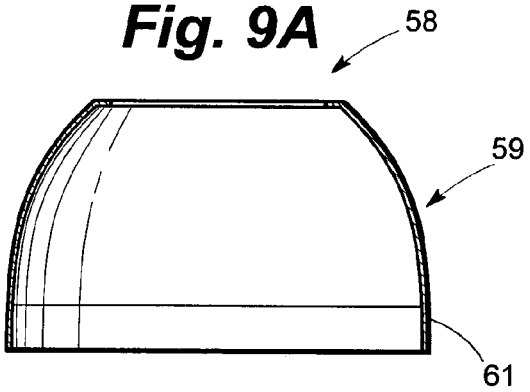
Fig. 9B
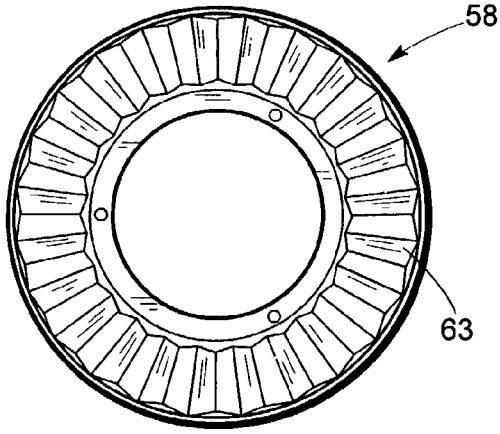
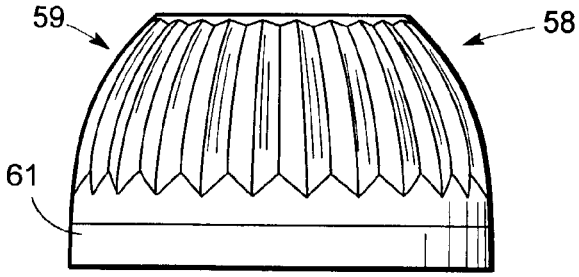
Fig. 9C
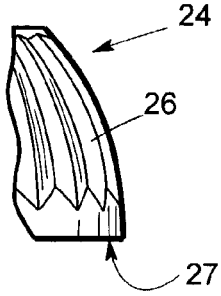
Fig. 9D

LUMINAIRE GLOBES HAVING INTERNAL LIGHT CONTROL ELEMENTS

BACKGROUND OF THE INVENTION

1. Field of the Invention

The invention relates generally to luminaires having reflector/refractor combinations and particularly to such combinations capable of producing desired cutoff characteristics with particular light distributions and either a fully luminous appearance or maintenance of the integrity of the daytime appearance during nocturnal operation.

2. Description of the Prior Art

Outdoor luminaires ordinarily mounted by posts or other stanchions have long been used with ornamental values being attendant to a requirement for a necessary level of illumination of a roadway, street, lane or other outdoor environment. Such post-mounted luminaires are usually each provided with a transparent or translucent globe within which a light source is mounted, the globe having an upper portion usually referred to as a reflector that is ordinarily formed of a light-transmissive material such as glass, acrylic, etc., as is conventional in the art. Such globes are typically also formed with a lower portion usually referred to as a refractor, the reflector/refractor combination typically being directly mounted to a post or the like. The refractor is also formed of the same or similar light-transmissive materials as forms the reflector, both the reflector and the refractor having prisms formed thereon for advantageous light control. Luminaires having such reflector/refractor combinations, that is, globes as aforesaid, are used to distribute light within the vicinity of such luminaires so as to illuminate an area about such luminaires. Luminaires configured with fully light-transmissive globes or with only the refractor being light-transmissive often are designed to provide a decorative function and are usually intended to outwardly resemble street lights of an earlier era. Luminaires of this kind are not only intended to be decorative but also highly efficient, it being also desirable for such luminaires to be configured with globes that are fully luminous in nighttime appearance so as to maintain the integrity of the full shape of the luminaire globes as said globes appear in sunlit conditions. For example, a common post-mounted luminaire is configured with a globe known as an "Acorn", this luminaire being of the kind produced by Holophane of Newark, Ohio under the trade designation "Granville", such a globe being shaped to have a pleasing appearance. When the Acorn globe is formed with a light-transmissive reflector and refractor, it is desirable to control the amount of light emanating from a light source contained within the globe so as to cause the upper reflective portion thereof to "glow" so that the complete shape of the luminaire globe is pleasingly visible during nighttime operation, the "glow" being produced without glare such as can be caused by too great an amount of light passing through the refractor. However, it is also desirable that such luminaires provide adequate illumination in the vicinity of the luminaires while also providing desirable cutoff characteristics, such as is often referred to as an I.E.S. cutoff, so as to further reduce glare and to minimize "light pollution". The necessity for achieving particular I.E.S. cutoff characteristics in such luminaires causes limitations to be placed on beam intensity at certain angles.

In luminaire configurations wherein at least major portions of a reflector are formed of a material that is not light transmissive, such as metal or similar substantially opaque materials, the reflective characteristics of such a reflector typically causes illumination that might otherwise be directed above a 90° horizontal plane to be reflected into lower portions of the luminaire globe, thereby reducing or eliminating an uplight component of the lighting produced by the light source contained within the luminaire globe. Such luminaires must also conform to I.E.S. standards for cutoff in order to reduce glare and light pollution and, desirably, should also produce a pleasing nocturnal appearance similar in shape to the sunlit appearance without creating harsh shadows on foliage and distinct cutoff shadows on building fronts and the like in the vicinity of a street or roadway that is to be illuminated.

Whether configured with light transmissive reflective portions or otherwise, luminaire globes of the prior art have typically employed refractors of differing configurations to conform to standards for the several I.E.S. types promulgated by the Illuminating Engineers Society as creating patterns useful for surface illumination. As one example, a pattern known as the Type II pattern is a desirable pattern for a luminaire located between roadway intersections due to the light delivered to surfaces over which traffic moves. A pattern referred to as the Type V pattern, a circular pattern, is considered to be desirable at intersections as another example. It is to be understood, however, that luminaire globes must often be configured to achieve a desired illumination externally of the luminaire and preferably with a fully luminous appearance when the globe is entirely light transmissive yet must also achieve desirable cutoff characteristics. In the attainment of such objectives, luminaires of the prior art often use lamping positioned horizontally within a reflector such that an arc tube of the lamp is at or above the horizontal plane of the reflector, this configuration having deficiencies as to luminaire appearance and typically necessitating the use of a dedicated horizontal burn lamp for producing sufficient illumination. Cutoff in such prior luminaires is typically accomplished by shielding illumination intensity above 90° through a particular configuration of the reflective portion of the luminaire globe itself.

Luminaire globes of the kind referred to herein are typically provided with prismatic structures on internal and/or external surfaces of globes, the prismatic structures typically being integrally formed therewith as is common in the art. As one example, Merritt, in U.S. Pat. No. 4,434,455, discloses a luminaire globe formed of a reflector and a refractor. Merritt does not provide a secondary reflective structure or light control structure within the interior of the disclosed luminaire globe. Orosz, in U.S. Pat. No. 4,719,548, discloses a luminaire globe having a light transmissive reflector and refractor and further having an integrally formed interior reflective structure formed with the reflective portion of the globe, the integrally formed interior reflector having a central aperture disposed therein such that light from a light source disposed primarily within the confines of the refractive portion of the globe directs a small amount of uplight into the light transmissive reflective portion of the globe such that upper portions of the luminaire globe appear to be illuminated. In U.S. Pat. No. 5,743,634, a combination of reflector/refractor is disclosed as having an internal perforated reflector that surmounts and surrounds a light source disposed within the globe, light from the light source passing through perforations formed in the reflector to illuminate upper portions of the globe. The disclosures of the three patents so mentioned are incorporated hereinto by reference.

It has become a desirable goal in the art to produce pole-mounted luminaires and similar luminaires having superior performance and reliability with appropriate cutoff characteristics especially with vertically mounted lamping.

In such luminaires, it is also desirable in most configurations to generate sufficient uplight so as to illuminate upper portions thereof thus yielding a fully luminous nighttime appearance but without "light pollution" or light trespass. The present invention finds solution to luminaire requirements as thus stated and with a continuing utilization of conventional heat-resistant, borosilicate glass or with acrylic reflectors and/or refractors, for example, the present luminaires being configured to meet I.E.S. cutoff requirements by providing Type II, III and V distributions, for example, thereby to provide luminaires suitable for effective area illumination through use of conventional lamping such as high pressure sodium and metal halide lamping inter alia.

SUMMARY OF THE INVENTION

The invention provides luminaire globes having reflector and refractor sections and having internal optics located relative to a light source within each of said globes for producing I.E.S. cutoff characteristics and particularly with vertically mounted lamping, the globes also typically producing an uplight component of sufficient intensity to create a glow within upper portions thereof when reflector sections are formed at least partially of light-transmissive material. In certain embodiments of the luminaire globe configurations of the present invention, a fully luminous globe appearance is provided during nighttime operation such that daytime shape integrity is maintained. Accordingly, the appearance of the present luminaire globe configurations need not be sacrificed due to the desirability of achieving certain I.E.S. cutoff characteristics. In accomplishing these results, the invention provides internal reflective optics of various configurations intended to control light emanating from a light source positioned within a luminaire globe, the light source and the internal reflective optics being disposed in an appropriate relation within said globe. The internal reflective optics are positioned in a predetermined relationship relative to the light source and, in certain embodiments, take the form of a metal or metallized internal reflector that surrounds the light source with an arc tube of said source being located above lower peripheral edges of the internal reflector, the internal reflector having an opening formed in an upper portion thereof above the light source. In certain embodiments the internal reflector can be configured as more than one reflector component. Through use of the several configurations of the present internal optics, it is possible to produce desired I.E.S. cutoff characteristics while producing the decorative affects detailed hereinabove. The invention also comprehends the configuration of luminaires capable of achieving I.E.S. semicutoff criteria.

Accordingly, it is an object of the present invention to provide a luminaire globe formed of a reflector and a refractor and which is capable of directing light downwardly through said refractor for area illumination while producing desired cutoff characteristics, especially when using a vertically mounted light source, a sufficient portion of that light generated by the light source contained within said globe causing upper portions of the globe in certain embodiments to "glow" or to be illuminated in certain embodiments of the invention such that the full shape of the globe can be visualized during nocturnal operation, diurnal appearance thus being maintained even during night hours when the luminaire is in use.

It is another object of the invention to provide luminaire globes formed of a reflector and a refractor and having internal optics positioned relative to a light source contained within such a globe so as to provide a desired degree of uplight while maximizing a desired illumination level externally of the luminaire globe while achieving desired cutoff characteristics.

It is a further object of the invention to provide luminaire globes of decorative appearance and configured with internal optics capable of causing the shape of such a globe as visualized during nighttime operation to be that same shape seen readily during daylight conditions and further having a pleasing "glow" or illuminated appearance under nocturnal conditions.

Further objects and advantages of the invention will become more readily apparent in light of the following detailed description of the preferred embodiments.

BRIEF DESCRIPTION OF THE DRAWINGS

FIG. 9A is a side elevational view in section of a preferred reflector used in the embodiment of FIG. 1;

FIG. 9B is a plan view of the reflector of FIG. 9A;

FIG. 9C is a side elevational view of the reflector of FIG. 9A;

FIG. 9D is a detail view of a further embodiment of a reflector used in a variation of the embodiment of FIG. 1;

DESCRIPTION OF THE PREFERRED EMBODIMENTS

Figure 1:
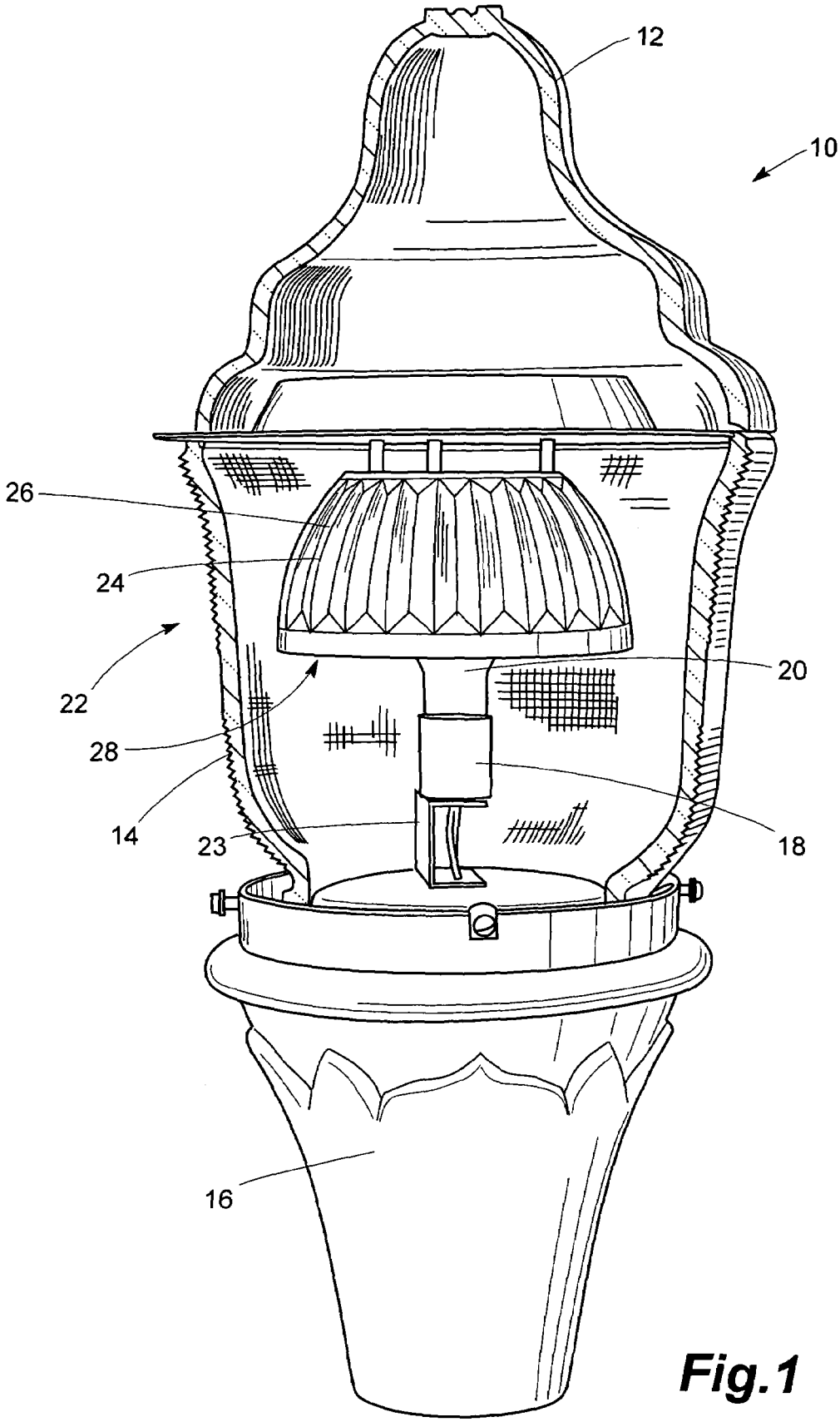
FIG. 1 is a perspective view partially cutaway of a first embodiment of the invention.

Preferred embodiments of the invention now shown explicitly in the drawings and described herein usually take the form of luminaire globes such as are mounted to distal ends of poles or such as are suspended in a pendant mounting arrangement such as from an arm extending laterally from a pole or stanchion of known conformation. In the several embodiments of the invention, light distributions conforming to standards promulgated by the Illumination Engineering Society of North America (I.E.S.) are produced, thereby to effectively illuminate an area in the vicinity of those luminaires employing the luminaire globes of the invention while meeting I.E.S. cutoff standards as well as Type II, III and V distributions. The luminaire globes of the invention are further configured to reduce direct uplight while controlling glare and addressing other environmental lighting issues such as urban sky glow and light trespass. In the several embodiments of the invention, classic globe shapes as are visible during daylight hours are essentially capable of being visualized during nocturnal operation, preferred embodiments of the invention typically directing a reduced amount of uplight into upper portions of said globes to cause said upper portions to subtly "glow" and define in concert with lower portions of the globes certain pleasing shapes associated with traditional luminaire appearances of bygone eras, for example. Such appearances are retained in luminaire globes configured to reduce lighting intensity at critical vertical angles so as to achieve I.E.S. cutoff while maximizing light efficiency.

Referring now to the drawings, the several embodiments of the invention can be appreciated with a first embodiment thereof being seen inter alia in FIGS. 1 through 4 wherein a luminaire globe of the invention is at 10 to have a reflector 12 surmounting a refractor 14, the reflector 12 and the refractor 14 being typically formed of borosilicate glass, acrylic, polycarbonate, etc., as is conventional in the art. In primary embodiments of the invention such as the embodiment of FIGS. 1–4, the reflector 12 and the refractor 14 are transparent due to formation from light-transmissive materials. The reflector 12 and the refractor 14 are typically formed with prisms (not expressly shown in FIGS. 2–4) over surfaces thereof, the prisms formed on the reflector 12/refractor 14 being essentially conventional in the art. Due to the refractive nature of the prisms formed on the reflector 12, it would be possible to refer to both portions of the globe 10 as "refractors"; however, the upper portion of the globe 10, that is, the reflector 12, is usually referred to in the art as a "reflector". The invention can be embodied as will be described hereinafter with an upper portion corresponding to the reflector 12 and which is formed of a material that is not light-transmissive. In all embodiments of the invention, lower portions of luminaire globes configured according to the invention and corresponding to the refractor 14 of the globe 10 are formed of light-transmissive materials as noted above and are further formed in exemplary embodiments with known prismatic structures causative of light distributions meeting I.E.S. Type II, III and V distribution standards, thereby permitting a choice best suited for effective illumination of a particular area being illuminated. In the several embodiments of the invention, efficient illumination is provided while effectively limiting beam intensity at 80° above vertical or straight down and at 90° and above, candela values being limited to 10 percent at 80° and 2.5 percent at 90°, the stated percentages being ratios of intensities to lamp lumens as examples.

The luminaire globe 10 is seen in FIG. 1 to be conventionally mounted to a ballast housing 16 configured to further mount the resulting assembly to a pole or stanchion (not shown) as is common in the art. The ballast housing 16 positively mounts the globe 10 to a pole or the like and also contains electrical components (not shown) and the like as is conventional such as a lamp socket 18 which accepts a lamp 20 in a vertical orientation for powered operation to produce light within the luminaire globe 10. In the several embodiments of the invention, an optical assembly such as the optical assembly 22 of FIGS. 1–4 functions to restrict light intensity at critical vertical angles while maintaining the integrity of the daytime shape. In those embodiments having globes with light-transmissive upper portions such as the reflector 12 of the globe 10, a fully luminous nocturnal appearance is created with an appropriate amount of uplight being directed into the reflector 12, that amount of uplight being sufficient to provide the desired appearance while maximizing the efficiency of area illumination and without a wasting of light unnecessarily directed upwardly through the reflector 12.

Figure 10:
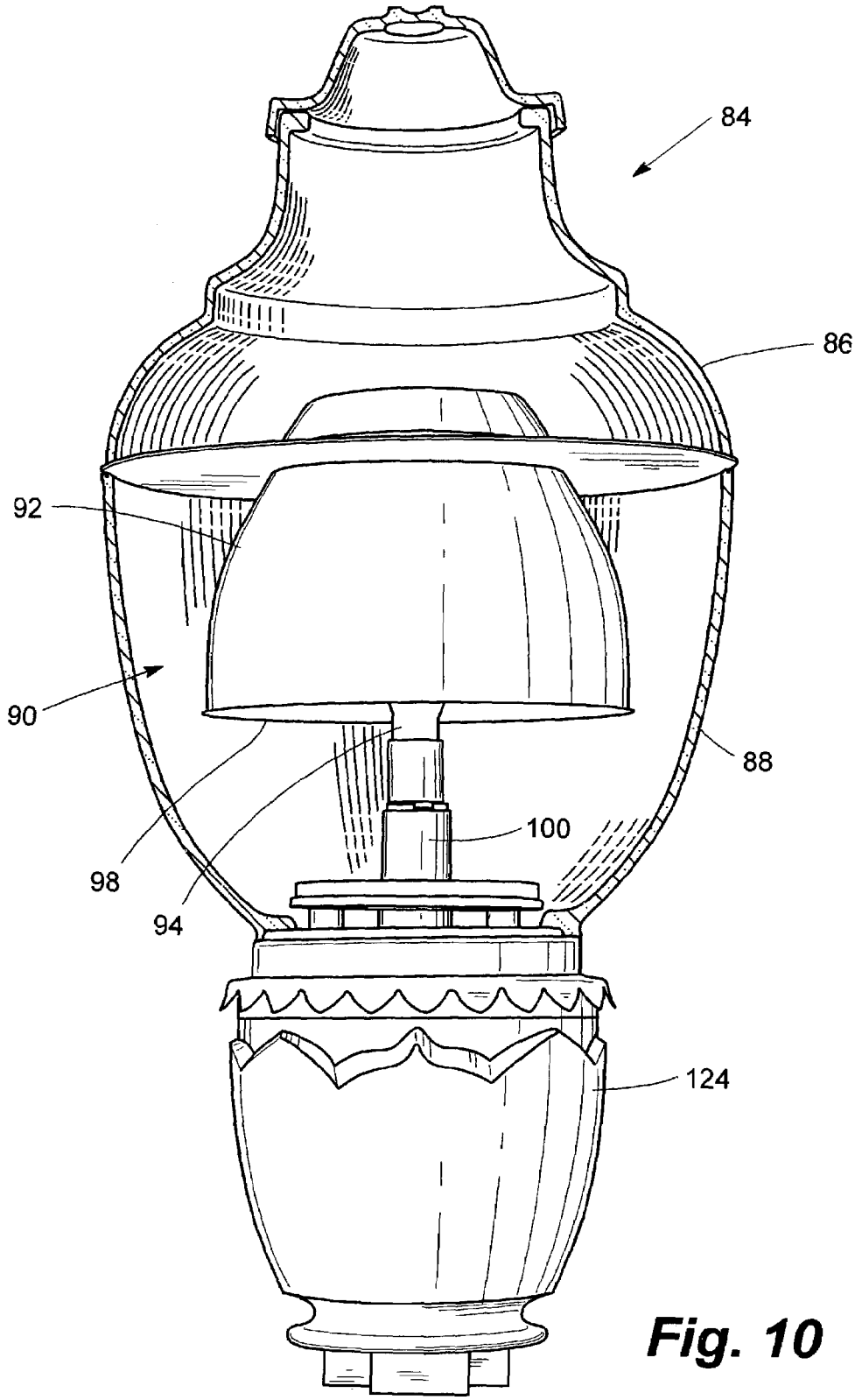
FIG. 10 is a perspective view partially cutaway illustrating a second embodiment of the invention.

Lamping employed in the several embodiments of the invention can take a variety of conventional forms in typical low, medium and high wattage ranges. For the embodiment of FIGS. 1 through 4 inter alia, high pressure sodium lamping being typically employed in a usual range of 70 to 175 watts; metal halide lamping being similarly employed in a usual range of 35 to 150 watts; mercury vapor lamping being employed in a usual range of 100 to 250 watts and incandescent tamping being employed in a usual range of up to 200 watts. In the embodiment of FIG. 10 inter alia, high pressure sodium tamping is typically employed in a usual range of 70 to 400 watts, metal halide tamping being similarly employed in a usual range of 35 to 400 watts while mercury vapor tamping is employed in a usual range of 100 to 400 watts. Incandescent tamping in the embodiment of FIG. 10 inter alia is typically employed in a range of up to 300 watts.

The lamp 20 of FIG. 1 inter alia is seen to be elevated within the globe 10 by means of a socket spacer 23. The spacer 23 can take any desired mechanical form and is dimensioned to position the lamp 20 in the appropriate location to yield the performance referred to herein.

Referring now again to FIGS. 1 through 4 and also to FIG. 9D inter alia, the optical assembly 22 is seen to be configured with a lower reflector 24 of a substantially "bowl" shape, the lower reflector 24 having a vertical section with essentially circular contours at 25 and tapering to perimetric lower edges at 27. The lower reflector 24 is preferably provided with substantially vertically oriented flutes 26 formed over surfaces thereof. The flutes 26 are particularly desired when high pressure sodium tamping is employed as the lamp 20. In such situations, the flutes 26 act to reduce reflection of light generated by the lamp 20 back into the lamp 20, thereby avoiding voltage rises in the lamp 20 that can reduce the useful life of the lamp. It is to be understood that the lower reflector 24 can be configured without the flutes 26 with retention of the objectives noted herein. Certain of the drawings do not show the flutes 26 for ease of illustration. While the configuration of the reflector 24 as shown is preferred in the embodiment of FIGS. 1 through 4 inter alia, it is to be understood that other reflective shapes can be employed such as a substantially elliptical configuration in the place of the substantially circular contours shown at 25, it being the function of the lower reflector 24 to encompass the lamp 20 such that the arc tube lies above lower perimetric edges 28 of the reflector 24 so that the intensity of that light emanating from about the edges 28 is at desirable levels and especially at "high" angles. When achieving I.E.S. semicutoff or in luminaires of other configuration, it is possible to position the arc tube to lie at or below lower perimetric edges of a given reflector. The lower reflector 24 is further provided with an upper opening at 30, a certain proportion of that light emanating upwardly from the lamp 20 passing through the opening 30 and eventually being used in part to contribute to a luminous appearance or a "glow" of the reflector 12. The lower reflector 24 functions to direct most of the light incident on inner surfaces thereof downwardly for eventual passage through the refractor 14. The lower reflector 24 is primarily intended to function so that light reflected thereby to the refractor 14, particularly to prismatic structures of the refractor 14, is presented thereto at as close an angle as possible as that of the light originating from the light source, that is, the lamp 20. In this manner, advantage is taken of the capabilities of the refractor 14 for optimization of incident radiation thereon for production of desired patterns of area illumination. The profile of the lower reflector 24 is thus selected to redirect lamp intensity to points falling below the lower perimetric edges 28 of said reflector 24 and just inside said edges 28. Light is thus maximized at as high an angle as possible, thereby maintaining the beam, while distributing light away from the globe 10 to permit desirable spacing between luminaires in outdoor applications as an example. The lower reflector 24 accomplishes such function while causing the main beam to be low enough to meet desired cutoff criteria at the angles of 80° and 90° and above respectively.

The lower reflector 24 is seen in FIGS. 1 through 4 to be mounted in spaced relation to a flat plate 32, the reflector 24 having an annular flange 34 defining the opening 30, the flange 34 providing structure facilitating the mounting of the reflector 24 to the plate 32 through the agency of apertures (not expressly shown in FIGS. 1 through 4) formed in said flange 34 through which screws 36 extend to mount said reflector 24 to the plate 32 and also to an upper reflector 38, the plate 32 and the upper reflector 38 also having apertures formed therein which align with the apertures formed in the lower reflector 24 to receive the screws 36. The flat plate 32 has a central opening 40 formed therein that aligns with the opening 30 of the lower reflector 24, said openings 30 and 40 also aligning with an opening 42 formed centrally of the upper reflector 38. Outer peripheral edges 44 of a flange 48 of the upper reflector 38 are received between respective peripheral edges of the reflector 12 and of the refractor 14, thereby to mount the optical assembly 22 within the interior of the globe 10. The edges 44 are held between the reflector 12 and the refractor 14 by a simple fitting therebetween which can be further improved by the use of an appropriate adhesive disposed between edges of the reflector 12 and the refractor 14, such an adhesive being conventional in the art.

Inner perimetric edges 46 of the flat plate 32 located about the opening 40 formed in the plate 32 extend inwardly of the connection between the flat plate 32 and the upper reflector 38, this inward extension of the edges 46 acting to reduce the intensity of the light beam at 90°. The upper reflector 38 is seen to be formed in a shape such as a frustrum of a cone with the peripheral flange 48 being formed outwardly thereof and having apertures as referred to herein formed in the body of the upper reflector to permit receipt of the screws 36 for mounting of the upper reflector 38 to the flat plate 32. The component portions of the optical assembly 22 are preferably formed of a metal such as aluminum, the lower reflectors 24 preferably being hydroformed of aluminum and anodized. The upper reflector 38 is preferably spun and then anodized. It is to be understood that the upper reflector 38 can be formed in other shapes such as a cylindrical shape while retaining the intended function of said reflector 38, this function being to contribute to the definition of the apparent "luminous shape" of the reflector 12 during nocturnal operation.

Figure 2:
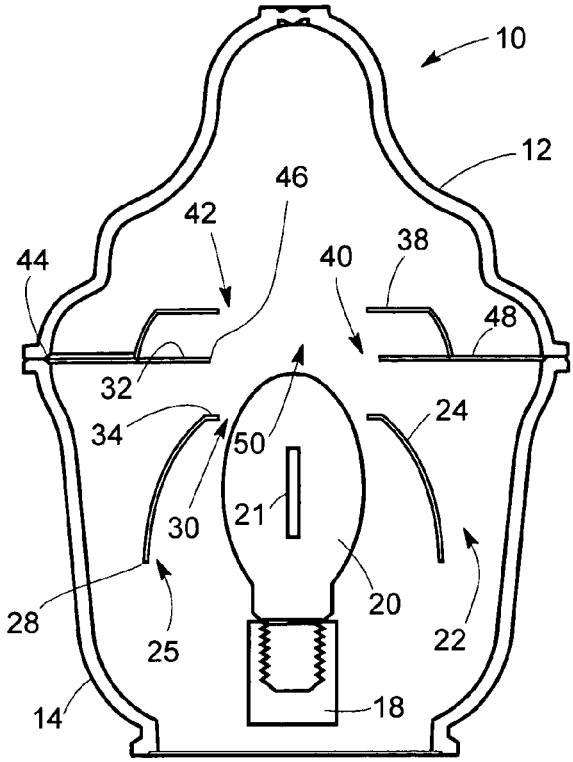
FIG. 2 is a schematic illustrating the structure of FIG. 1.
Figure 3:
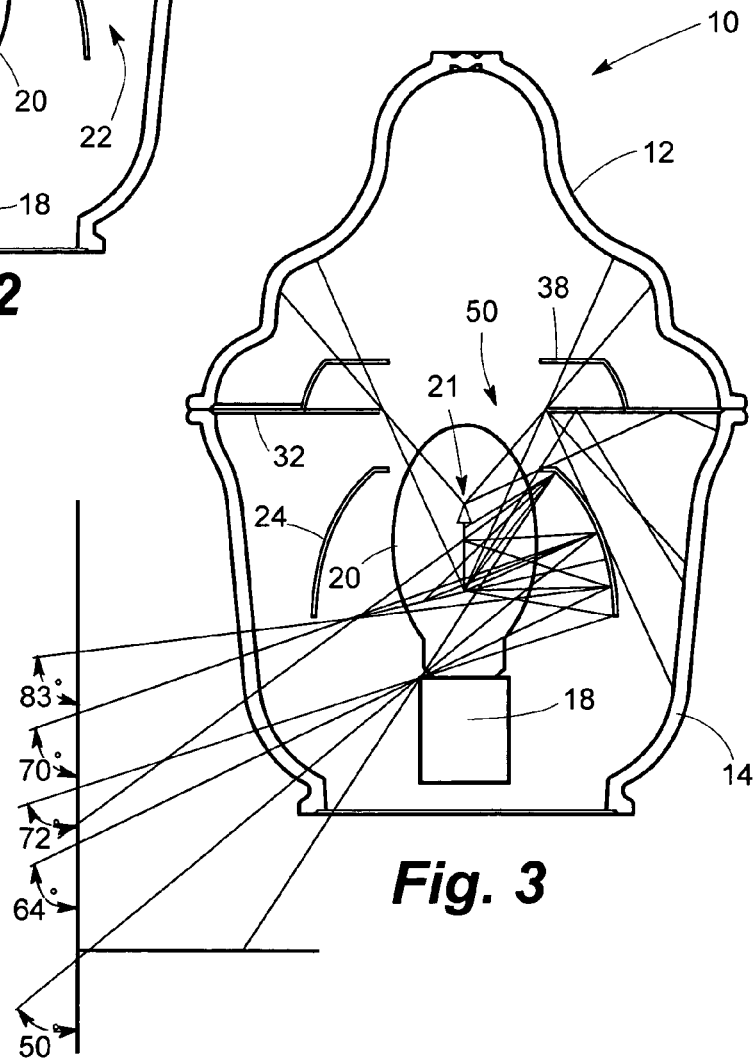
FIG. 3 is a schematic illustrating optical function of the structure of FIG. 1.

In FIG. 1 the reflector 12 and the refractor 14 are partially cutaway to reveal the optical assembly 22, the position of the optical assembly 22 being further shown schematically in FIGS. 2 and 3. The position of the optical assembly 22 within the globe 10 determines the quantity of light that escapes from the globe 10 through the refractor 14 as well as the quantity of light that escapes from upper portions of the optical assembly 22. Positioning of the optical assembly 22 in a relatively low location within the globe 10 with respect to the lamp 20 causes the reflected beam to be lower to the point where the beam is obstructed by the peripheral edges 28 of the lower reflector 24. For a given depth of the lower reflector 24, the lower the reflector 24 is positioned within the globe 10 the greater a gap seen at 50 becomes between the upper reflector 38 and the lower reflector 24, thereby allowing more light to escape through the gap 50 so created. The light that escapes through the gap 50 illuminates upper portions of the refractor 14 which portions are otherwise hidden from the lamp 20, thereby giving those portions of the refractor 14 a glow.

The upper reflector 38 is positioned within the globe 10 above the plane of upper portions of the lower reflector 24 to accommodate the vertical length of the lamp 20. The lamp 20 protrudes through the opening 30 in the lower reflector 24. The opening 30 is dimensioned to contribute to achievement of desired cutoff standards. The opening 42 in the upper reflector 38 is typically between 2.5 and 3.5 inches and preferably 2.75 inches for an optical assembly 22 sized for a globe 10 of conventional dimension. The globe 10 as seen in FIGS. 1–4 is taken to be a conventional globe known as the Granville, the globe being manufactured by Holophane of Newark, Ohio. The size of the opening 42 is chosen to limit upward light intensities to below cutoff criteria, it being desirable also to raise the plane within which the opening 42 lies to a location above the plane of the junction between the reflector 12 and the refractor 14. The gap 50 is preferably chosen in the embodiment of FIGS. 1–4 to be between 1.25 inches and 1.75 inches, the gap 50 being the distance between the top plane of the upper reflector 38 and the top plane of the lower reflector 24. The larger the dimension of the gap 50, the more light is caused to fill in the glow of portions of the refractor 14. Beyond a certain sizing of the gap 50, however, too much light is allowed to be distributed upwardly causing I.E.S. cutoff criteria to be exceeded, the plate 32 being employed for the purpose of reducing upwardly distributed light.

The lamp 20 has a light center as represented at 21, this light center 21 essentially being at an arc tube of the lamp 20. The position of the light center 21 within the globe 10 and relative to the optical assembly 22 impacts attainment of I.E.S. cutoff criteria. Raising the position of the light center 21 within the globe 10 even without inclusion of the optical assembly 22 therein causes the angular position of the resulting beam to be lowered, the lower the angle of the main beam causing an increased likelihood of meeting I.E.S. cutoff criteria. Raising the lamp 20 within the globe 10 also increases the relative angle between the lamp 20 and the lower reflector 24, thereby lowering reflected light. The light center 21 of the lamp 20 is positioned near the top of the lower reflector 24, upper portions of the lamp 20 above the light center 21 typically extending through the respective openings 30, 40 in the lower reflector 24 and the flat plate 32, said openings 30, 40 functioning in part to accommodate the size of the lamp 20.

It is to be understood that the position of the light center 21 of the lamp 20 is located upwardly within the globe 10 having the optical assembly 22 disposed therein in relation to the position of an optical center of a lamp within the conventional Granville luminaire referred to herein, said conventional Granville luminaire having a globe formed of a reflector and a refractor essentially identical to the reflector 12 and the refractor 14 of the globe 10 described herein. Discussion herein of the raising of the light center 21 of the lamp 20 within the globe 10 compares the location of said light center 21 in the presently configured globe 10 with the location of the light center of a lamp conventionally used in the conventional Granville luminaire.

In situations wherein components (not shown) disposed in proximity of the globe 10, such as on interior portions of the ballast housing 16, are particularly reflective as can be caused by painting of such components a gloss white color, diffuse reflections can occur which affect the achievement of I.E.S. cutoff criteria particularly at 90° and above. Such components can preferably be painted a relatively non-reflective dark color such as black in order to decrease the magnitude of such diffuse reflections.

Figure 4:
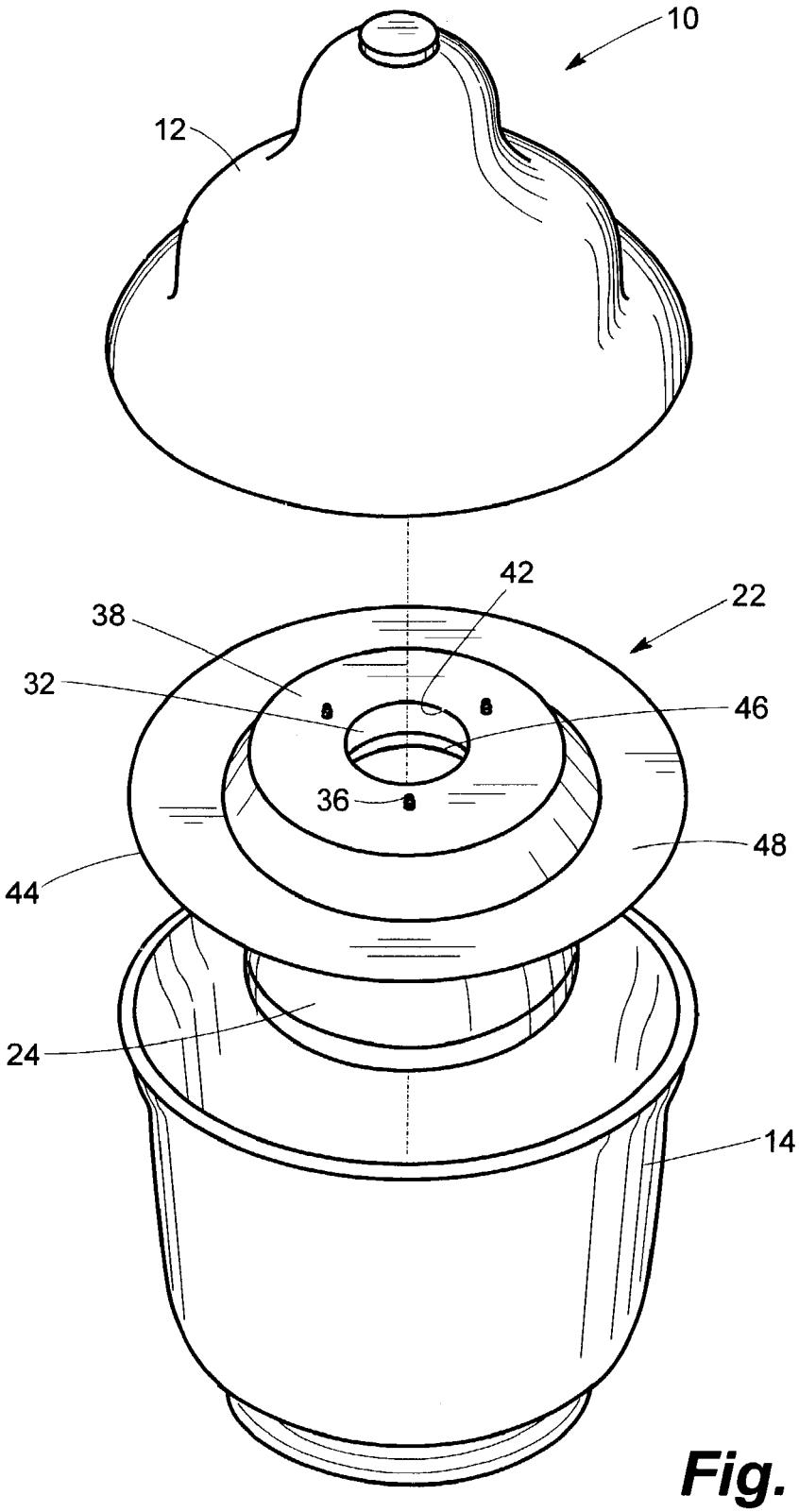
FIG. 4 is an exploded perspective view of the embodiment of FIG. 1.
Figure 7:
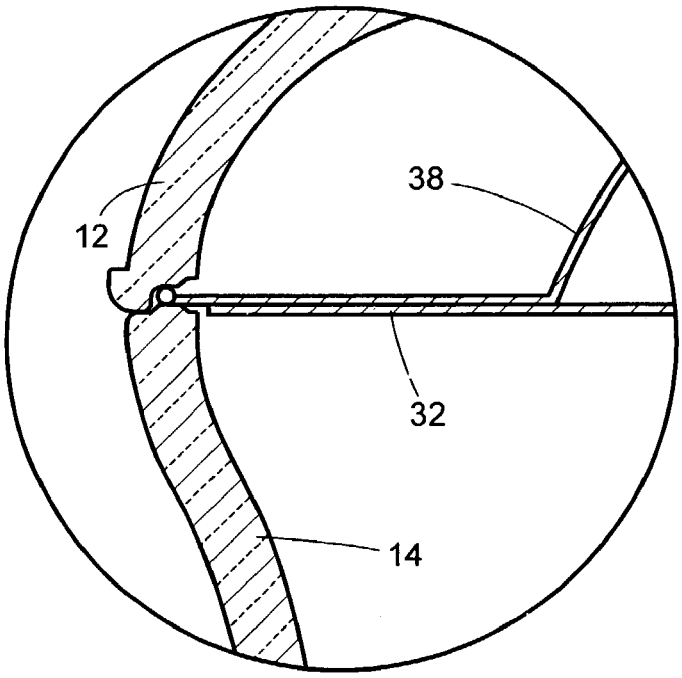
FIG. 7 is a detail sectional view of a mounting detail.

In FIG. 3, the angles at which beams emanate from the optical assembly 22 are illustrated. FIG. 4 particularly illustrates the relationship of the optical assembly 22 relative to the reflector 12 and the refractor 14. The refractor 14 preferably takes any one of three particular refractive structures as can further be appreciated by reference to FIGS. 5A, 5B and 5C. In FIG. 5A, an asymmetric glass refractor is chosen as the refractor 14, the globe of FIG. 5A being the globe 10 described relative to FIGS. 1–4, the globe 10 being intended to provide a Type III distribution. In globe 52 of FIG. 5B, an optical assembly 56 is disposed within said globe 52, the optical assembly 56 having components similar to the lower reflector 24 and the upper reflector 38 of the optical assembly 22 of FIG. 5A. However, the optical assembly 56 is configured with a lower reflector 58 that is of a greater height relative to the lower reflector 24 such as is seen in FIGS. 9A through 9D and with an upper reflector 60 substantially identical to the upper reflector 38, the optical assembly 56 not being configured with a flat plate corresponding to the flat plate 32 of the embodiment of FIG. 5A. Inclusion of a flat plate in the optical assembly 56 of the globe 52 is not necessary to produce desired cutoff criteria in Type II configurations. The globe 52 is understood to preferably utilize an asymmetric glass refractor 54 of conventional design for achievement of the desired I.E.S. cutoff criteria. A reflector 55 essentially identical to the reflector 12 can be used to complete the globe 52. In forming the optical assembly 56 of FIG. 5A, the lower reflector 58 is affixed directly to the upper reflector 60 by means of screws 62 with spacers 63 being employed to maintain desired relative locations between the reflectors 58, 60. A peripheral flange 64 of the upper reflector 60 is dimensioned to permit mounting of the optical assembly 56 within the globe 52 by locating peripheral edge portions of the flange 64 between peripheral edges of the reflector 52 and the refractor 54 as is seen in FIG. 7. The plane of the upper edges of the lower reflector 58 is preferably substantially coincident within the plane in which the flange 64 of the upper reflector 60 lies. In other words, a gap at 66 between the upper reflector 60 and top portions of the lower reflector 58 is less than the corresponding gap 50 of the optical assembly 22 of the globe 10. The optical assembly 56 mounts between the refractor 54 and the reflector 55.

Figure 5C:
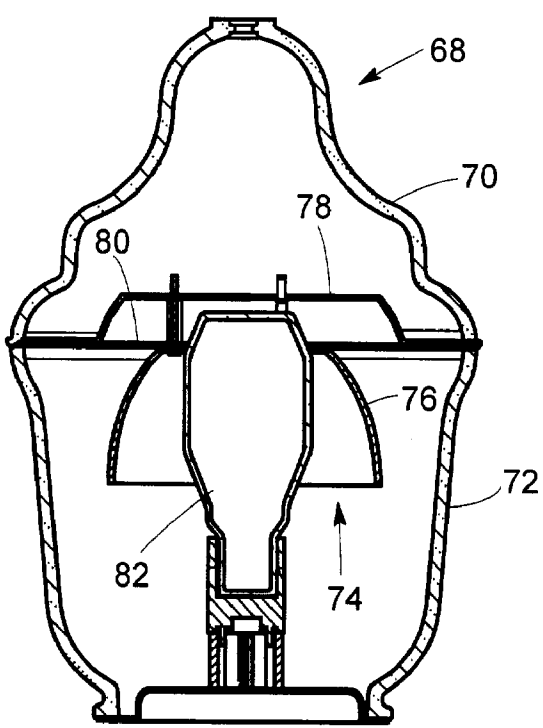
FIGS. 5A, 5B and 5C are idealized sectional views of variations of the embodiment of FIG. 1.

In FIG. 5C, a globe 68 is seen to be formed of a reflector 70 and a refractor 72, the refractor 72 being a conventional symmetric glass refractor capable of producing a Type V distribution. Components of an optical assembly 74 contained within the globe 68 are essentially identical to components of the optical assembly 22 except that a lower reflector 76 is essentially identical to the lower reflector 24 of FIG. 5A. An upper reflector 78 and a flat plate 80 correspond respectively to the upper reflector 38 and the flat plate 32 of the optical assembly 22 of FIGS. 1–4 and are mounted together with the lower reflector 76 with upper portions of the lower reflector 76 being in a plane that is essentially coplanar with the plane of the flat plate 80.

Figure 5B:
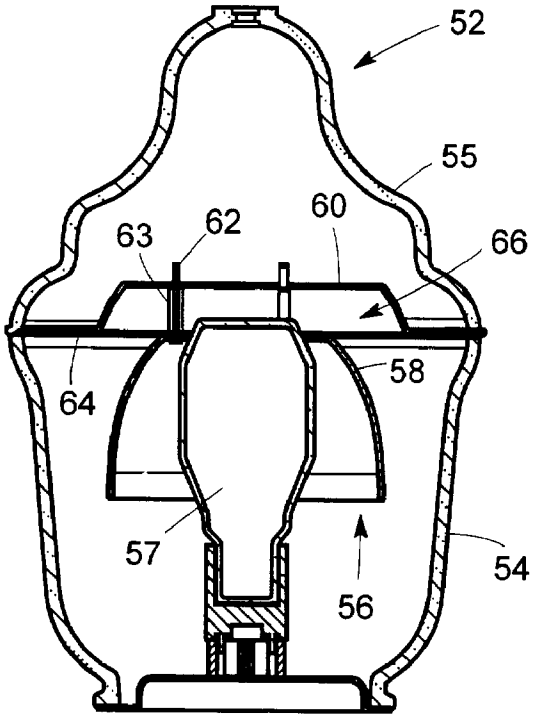
Figure 5A:
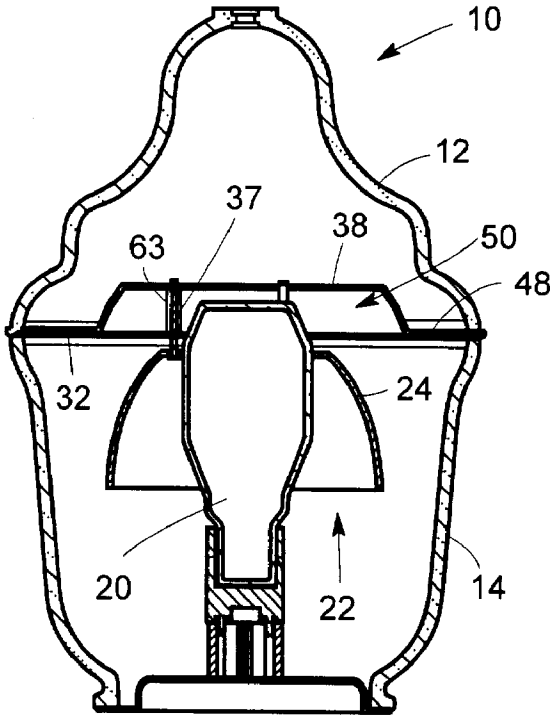
Figure 6B:
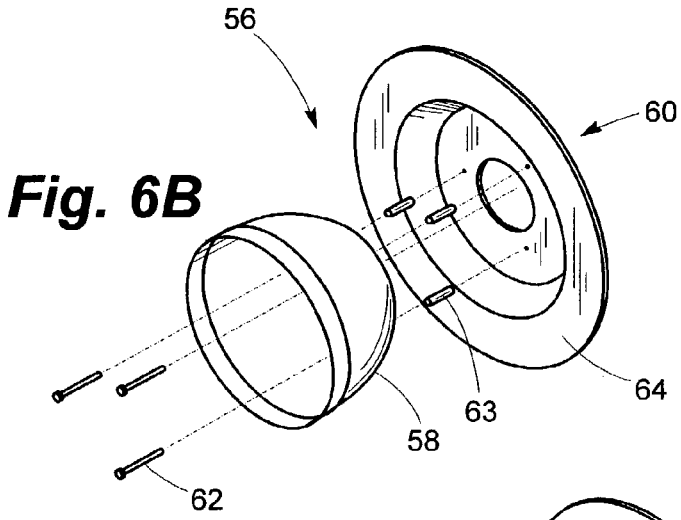
FIGS. 6A, 6B and 6C are perspective views of optical structure corresponding to the variations seen respectively in FIGS. 5A, 5B and 5C.
Figure 6A:
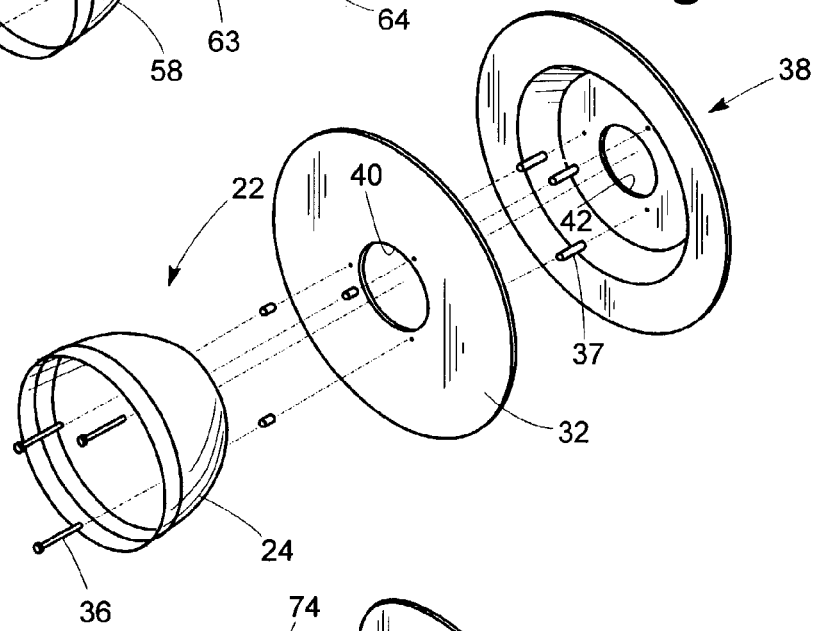
Figure 6C:
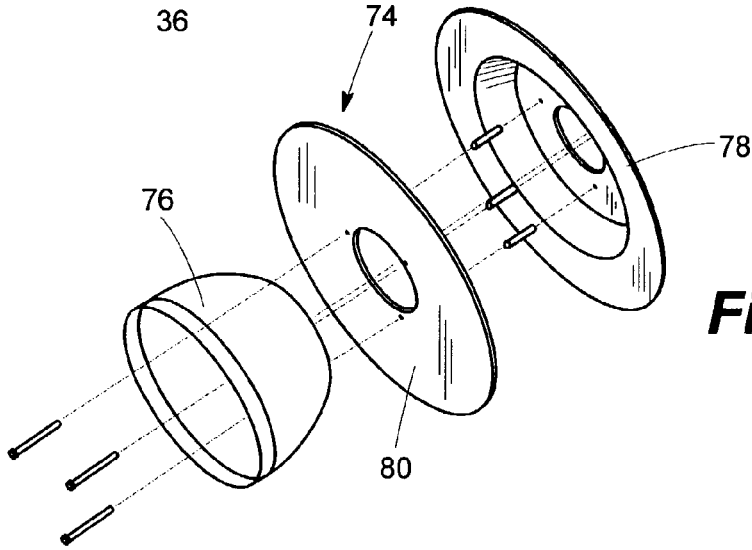

FIGS. 5A, 5B and 5C can be better appreciated with reference to FIGS. 6A, 6B and 6C which respectively illustrate the optical assemblies 22, 56 and 74 in exploded views. Referring to these drawings, it is to be seen that the lower reflector 24 of FIG. 5A has a lesser height than the height of the lower reflector 58 of FIG. 5B, a difference chosen to facilitate achievement of appropriate I.E.S. cutoff criteria. In FIG. 5B, the distance between lowermost portions of the refractor 14 to the light center 21 of the lamp 20 is 0.25 inch lower than in the optical arrangements of FIGS. 5A and 5C.

The respective optical assemblies 22, 56 and 74 of the globes 10, 52 and 68 of FIGS. 5A, 5B and 5C inter alia differ by virtue of the fact that the respective refractors 14, 54 and 72 are of differing configurations due to the nature of prisms dispersed over exterior and interior surfaces of said refractors. Achieving desired I.E.S. cutoff criteria with desired luminous appearance and maximization of luminaire light output also necessitates optimization of lamp position, reflector length (of the lower reflectors 24, 58 and 76 respectively), reflector position and relative locations of the components of the optical assemblies within said assemblies. The globe 10 of FIG. 5A is configured with the refractor 14 having vertical prisms (not shown) on interior surfaces and horizontal prisms (not shown) on exterior surfaces as is conventional in the art. When utilizing mogul-based lamps, the lamp 20 is positioned 0.25 inch lower in the globe 10 than in the globes 52 and 68 in order to achieve desired I.E.S. cutoff criteria and to maximize light output. When using medium-based lamps, the optical assemblies 22, 56 and 74 will have the same lamp position. In the globe 52, luminaire efficiency is increased with maintenance of luminous appearance without the need for a flat plate corresponding to the flat plate 32 of the globe 10, I.E.S. cutoff being also achieved without a flat plate. The lower reflector 58 of the optical assembly 56 is of a length that is 0.75 inch longer relative to the length of the lower reflectors 24 and 76 so as to prevent light beams from exceeding cutoff requirements.

The globe 10 of FIG. 5A inter alia is configured with the refractor 14 having Blondel prisms (not shown) vertically oriented on interior surfaces thereof and with traditional prisms (not shown) on exterior surfaces. The lamp 20 is positioned in a relatively higher location within the globe 10 relative to a conventional Granville globe. In the optical assembly 22 of FIG. 5A, light traveling into the upper reflector 38 can be reflected back into the refractor 14 and can exceed 90° cutoff criteria unless the flat plate 32 is positioned between the lower reflector 24 and the upper reflector 38. Spacing of the lower reflector 24 from the flat plate 32 at a distance of 0.5 inch through use of spacers 37 through which the screws 36 extend permit enough uplight for maintenance of a luminous appearance without exceeding 90° cutoff. The height of the lower reflector 24 is lesser relative to the height of the lower reflector 58 of FIG. 5B in order to achieve I.E.S. cutoff.

The globe 68 of FIG. 5C inter alia is configured with the refractor 72 having vertical Blondel prisms (not shown) on interior surfaces and traditional horizontal prisms on exterior surfaces as is conventional in the art. The position within the globe 68 of lamp 82 is chosen to be in a relatively high location in order to meet I.E.S. cutoff. The flat plate 80 is used in the optical assembly 74 for the same reasons as the flat plate 32 is used in the optical assembly 22. The height of the lower reflector 76 is reduced relative to the height of the lower reflector 58 of FIG. 5B for the same reasons as detailed relative to the height of the lower reflector 24 of FIG. 5A.

Figure 8:
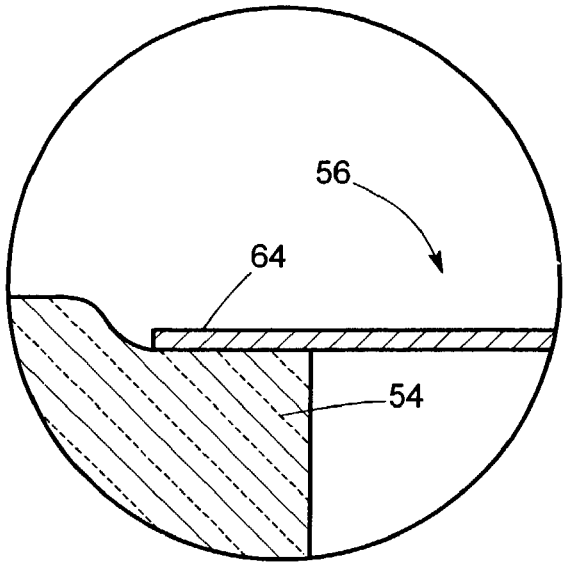
FIG. 8 is a detail sectional view of another mounting detail.

Referring now to FIGS. 7 and 8, typical arrangements of a portion of any one of the optical assemblies disposed on a peripheral surface of one of the refractors is seen, a globe being then completed by securing one of the reflectors to the refractor as shown. In FIG. 7, a portion of the upper reflector 38 is disposed between peripheral edges of the reflector 12 and the refractor 14 and said edges are adhered together. In FIG. 8, the flange 64 of the optical assembly 56 is seen to lie in contact with a peripheral edge of the refractor 54, the refractor 54 being hinged to the reflector 55 (not shown in FIG. 8).

Referring now to FIGS. 9A through 9D, the lower reflector 24 seen in FIG. 9D is understood to be essentially the same structure as the lower reflector 76 of FIGS. 5C and 6C. The lower reflector 58 of FIGS. 5B and 6B is seen in FIGS. 9A, 9B and 9C to be formed with circular surfaces at 59 as seen in vertical section, the surfaces 59 tapering to a depending skirt 61. The lower reflector 58 is essentially identical to the lower reflectors 24 and 76 with the exception of the skirt 61 which causes the lower reflector 58 to have a greater length than the reflectors 24, 76. As is noted herein, the reflector 58 is used in the embodiment of FIG. 5B, this embodiment being without a flat plate such as the flat plate 32 of FIG. 5A inter alia.

Referring now to FIG. 10, a luminaire globe 84 is seen to be formed of a reflector 86 and a refractor 88, the reflector 86 and the refractor 88 being essentially in function to the reflector 12 and the refractor 14 of the globe 10 shown in FIGS. 1–4 inter alia. The globe 84 is shaped and formed in the manner of the Washington Postlite globe manufactured by Holophane of Newark, Ohio, the globe 84 having a distinctively different shape when compared to the globes 10, 52 and 68. The different shape of the globe 84 requires modification of an optical assembly 90 relative to the optical assemblies referred to hereinabove in order to produce desire I.E.S. cutoff and a fully luminous nocturnal appearance so that the integrity of the daytime shape is maintained. In the optical assembly 90 shown in the partially cutaway view of FIG. 10, a reflector 92 preferably having a parabolic shape is employed to fit about lamp 94. The shape of the reflector 92 can be chosen to be other than parabolic. As examples, reflectors in vertical section such as circular reflectors, elliptical reflectors and other reflectors of known shape can be used. The lamp 94 is intended to be surrounded by the reflector 92, the lamp 94 having an arc tube 96, that is, the effective light center, as best seen in FIG. 10, that is located above lower peripheral edges 98 of the reflector 92 at a sufficient distance such that cutoff can be achieved. The reflector 92 is positioned within the globe 84 with the lower peripheral edges 98 of the reflector disposed approximately three inches higher within the globe 84 than would be the case with lower edges of the lower reflectors 24, 58 and 76 described hereinabove. A socket base 100 used to mount the lamp 94 is also extended upwardly within the globe 84 relative to the position shown for the socket 18 described above so that the lamp 94 and a light center thereof is positioned higher within the globe 84 relative to the position of a lamp within a conventional Washington Postlite globe in order to increase the gap between the lower peripheral edges 98 of the reflector 92 and the bottom of the globe 84. Accordingly, light output, that is, efficiency, is increased from values for a given lamping such as from under 30 percent to over 40 percent. Raising the position of the lamp 94 as noted acts to suppress, that is, lower, the main beam angle. In order to accommodate this design factor, the contour of the reflector 92 is chosen to compensate for beam suppression with the intent being the redirection of light from the lamp 94 to prisms 102, thereby causing incident light from the reflector 92 and onto the prisms 102 to be similar to the angle of incidence of direct light from the lamp 94 onto the prisms 102 as would occur with a lamp mounted lower within a globe such as described herein relative to a conventional Washington Postlite globe. Since the intent is to accomplish the objectives thus noted while achieving cutoff, the preferred shape of the reflector 92 was determined to be parabolic as best seen in FIG. 9 inter alia. Limitations exist on the distance within the globe 84 that the lamp 94 can be raised to increase efficiency while maintaining a desired beam angle since the reflector 92 cannot redirect all of the direct light emanating from the lamp 94. Accordingly, it is preferred that the lamp 94 be raised within the globe 84 a distance of between 2 and 3 inches relative to the position of a lamp used in a conventional Washington Postlite globe. The contours of other globes require consideration of the concepts of the invention as detailed herein for determination of particular positioning of lamping and reflective structures within said globe, it being necessary to also consider the shape and contours of such globes as can place physical constraints on the locations at which such lamping and reflective structures can be placed.

Figure 13:
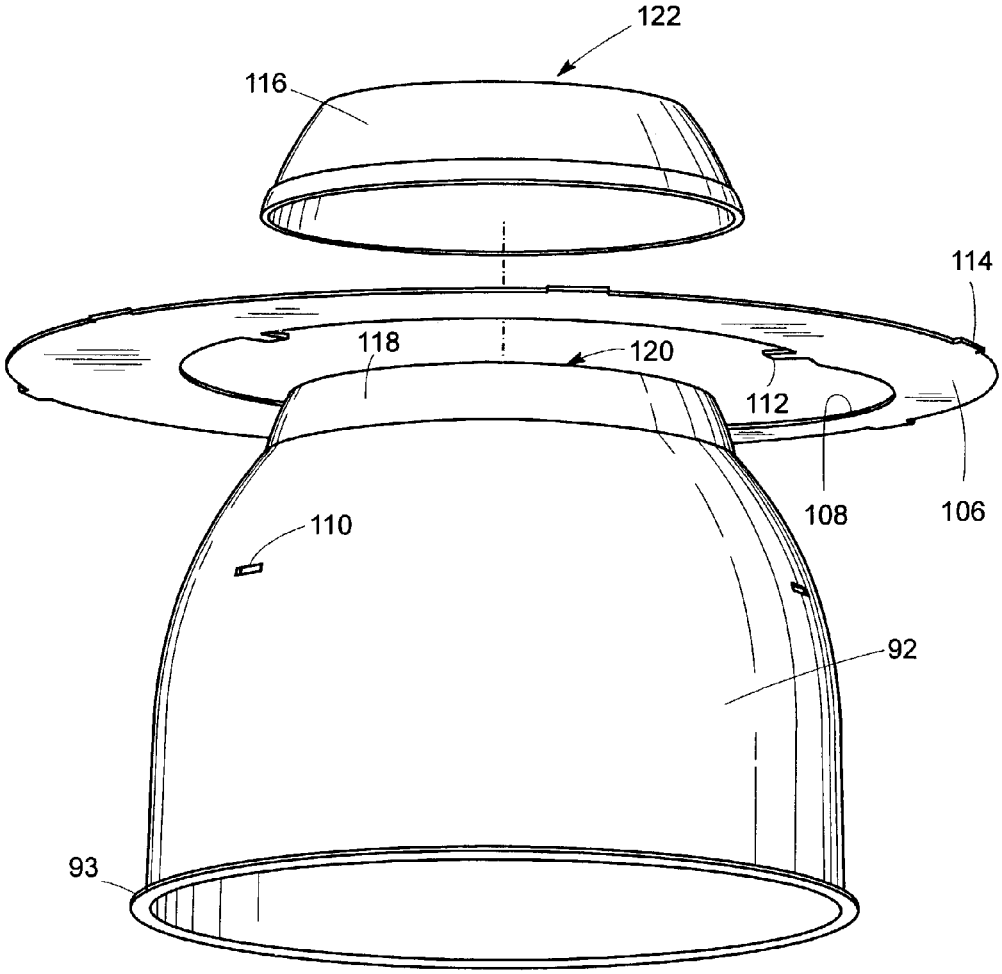
FIG. 13 is an exploded perspective view of internal optics embodied in the structure of FIG. 10.
Figure 14A:
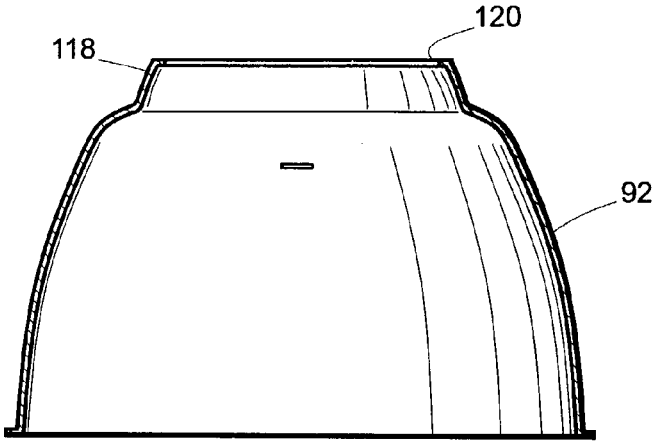
FIG. 14A is a side elevational view in section of a preferred reflector used in the embodiment of FIG. 10.
Figure 14B:
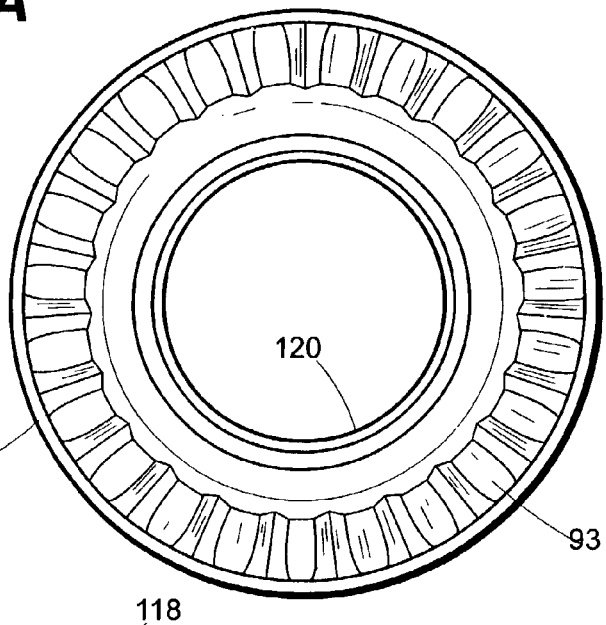
FIG. 14B is a bottom view of the reflector of FIG. 14A.
Figure 14C:
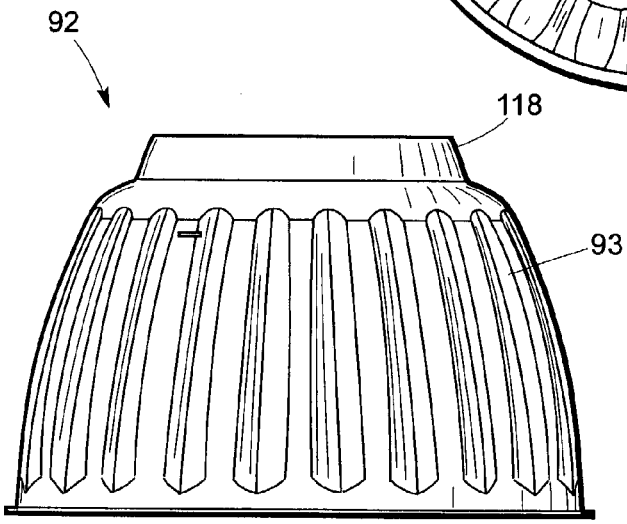
FIG. 14C is a side elevational view of the reflector of FIG. 14A.
Figure 14D:
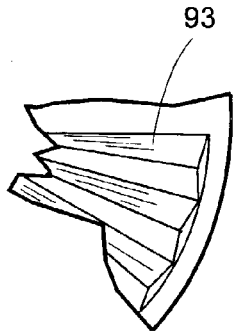
FIG. 14D is a detail view of a portion of the reflector of FIG. 14A.

Further reference to FIG. 10 as well as to FIG. 13 inter alia illustrates the use of a flat plate 106 as structure intended to mount the reflector 92 within the globe 84, the plate 106 having a central opening 108 for receiving the reflector 92 thereinto. The reflector 92 is formed with regularly spaced slots 110 formed in surfaces thereof at a location of the reflector 92 that is dimensioned to be essentially the same as the size of the opening 108 of the plate 106, tabs 112 extending from peripheral edges of the opening 108 to be received into the slots 110 and then bent to hold the reflector 92 to the plate 106. The plate 106 is further seen to have tabs 114 regularly disposed about its outer periphery, the tabs 114 being received between opposing edges of the reflector 86 and of the refractor 88 when assembled together so that the plate 106 and the attached reflector 92 are held at the desired position within the globe 84.

Figure 11:
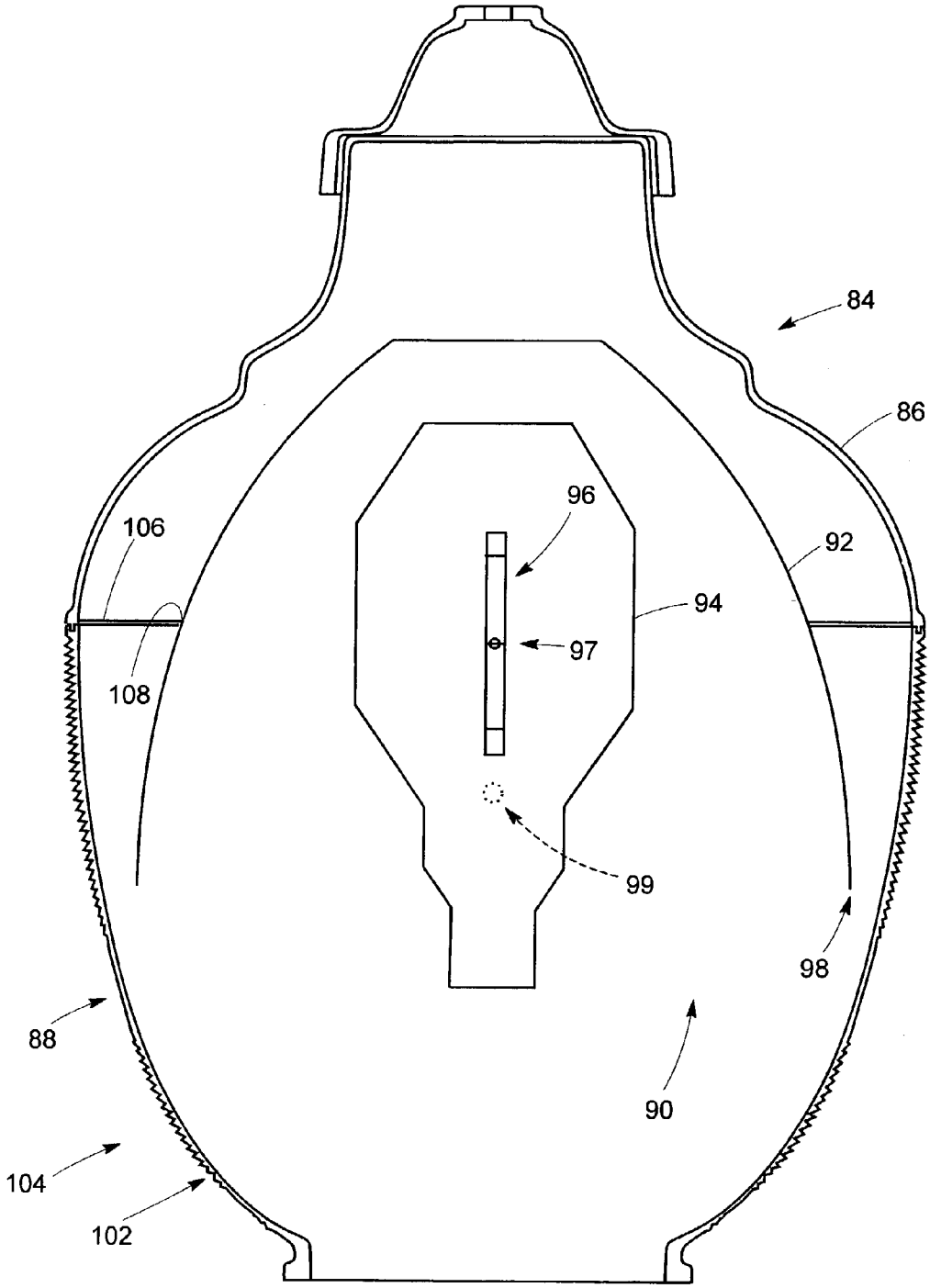
FIG. 11 is a schematic illustrating the relationship of a light source and internal optics of the embodiment of FIG. 10.

As can best be seen in FIGS. 10 and 13, a cover 116 mounts to a neck 118 of the reflector 92, the neck 118 being shaped to mate with interior surfaces of the cover 116. The cover 116 extends the effective length of the reflector 92 since said cover 116 is also reflective and is intentionally formed of a reflective material such as anodized aluminum as is the reflector 92. However, it would be possible to form the cover 116 as an integral extension of the reflector 92 except that the size of opening 120 at the top of the reflector 92 must be large enough to permit relamping. Since the effective opening at the top of the reflector 92 needs to be smaller for optical considerations, it becomes necessary to extend the reflector 92 through the agency of the cover 116 so that opening 122 in the cover 116 is sized to be of appropriate dimensions and can be removed from assembly with the reflector 92 to allow relamping through the large opening 120. In the schematic of FIG. 11, the reflector 92 is shown as an integral structure without illustration of a separate cover such as the cover 116.

Referring once again to FIG. 10, the luminaire globe 84 is seen to mount in a conventional fashion to a ballast housing 124 of conventional design and function. The globe 84 can conventionally be fitted with decorative finials or caps of varying description at the top thereof as is also conventional in the art. The reflector 92 is provided with a flange 93 for strengthening purposes.

Referring now to FIG. 11, the relative position of the lamp 94 within the globe 84 is compared schematically to the position of a lamp within a conventional Washington Postlite globe, a light center of this conventional globe being represented at 99. The effective light center at 97 of the lamp 94 is seen to be disposed at a higher position within the globe 84 relative to the position of the light center 99 of the conventional Washington Postlite globe. The position of the light center 97 of the lamp 94 causes the main beam to exit the globe 84 at angles of between 60° and 75°.

Referring now to FIGS. 14A through 14D, the reflector 92 is seen to be preferably provided with flutes 93 for essentially the same reasons for providing the flutes 26 on the reflector 24 inter alia described herein. While the reflector 92 can be configured without the flutes 93, such use of the reflector 92 with high pressure sodium lamping causes use to be desirable.

Figure 12C:
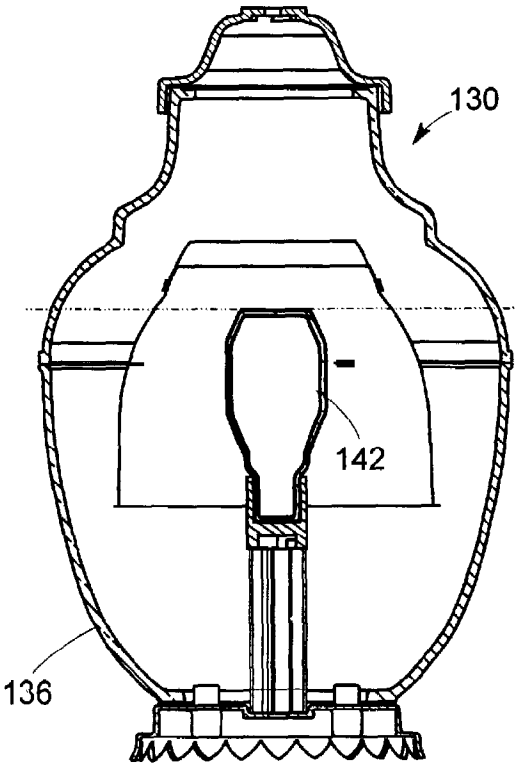
FIGS. 12A, 12B and 12C are idealized sectional views of variations of the embodiment of FIG. 10.
Figure 12B:
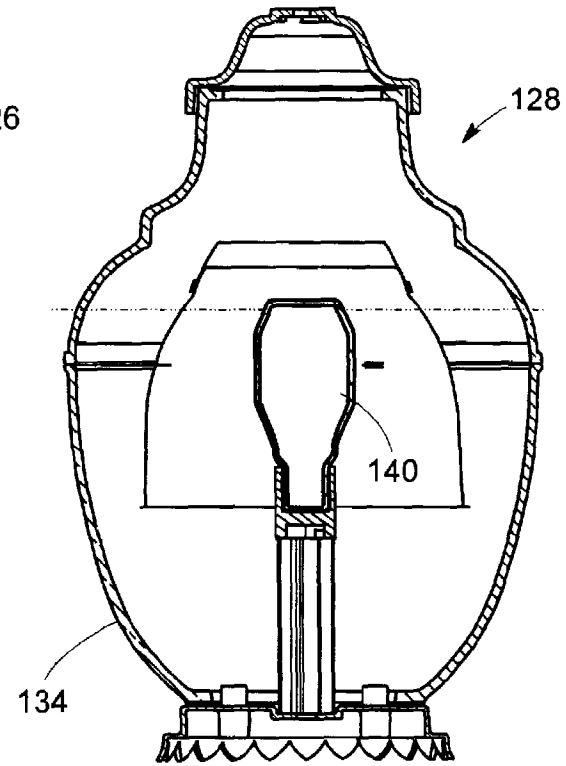
Figure 12A:
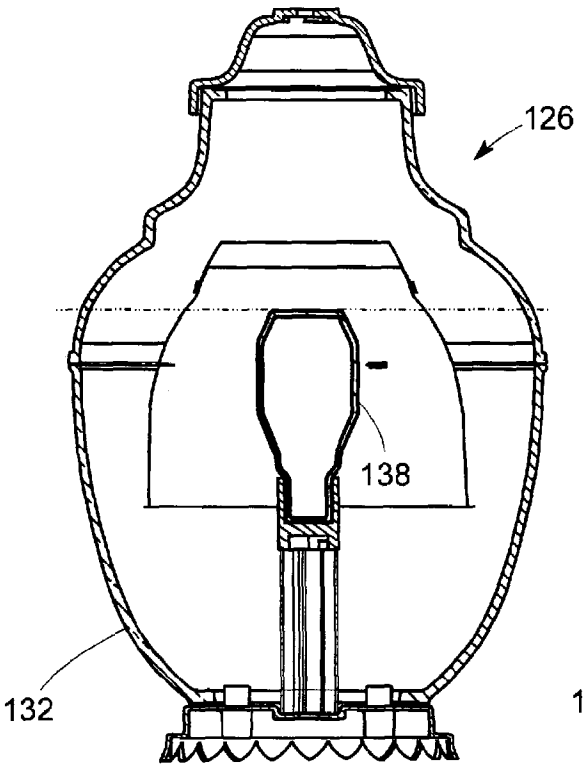

Referring now to FIGS. 12A, 12B and 12C, the globes 126, 128 and 130 are seen to be configured with refractors 132, 134 and 136 respectively of Type III, IV and V respectively. In the globe 128, cutoff is achieved by raising lamp 140 to a higher position within said globe 128 relative to the position of the lamps 138 and 142 of the respective globes 126 and 130.

Figure 15:
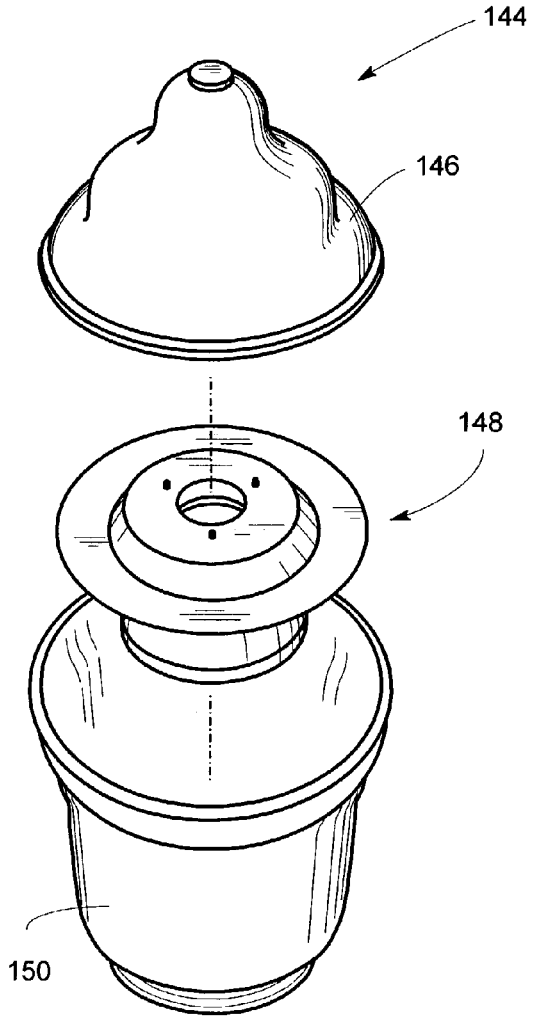
FIG. 15 is an exploded perspective view illustrating a third embodiment of the invention; and, FIG. 16 is an elevational view of a luminaire globe configured according to the invention and mounted in a suspended use environment.

As can be seen in FIG. 15, a globe 144 can be configured with a reflector 146 formed of a material that does not transmit light, the globe 144 being provided with an optical assembly 148 that is essentially identical in structure and function to any one of the optical assemblies shown respectively in FIGS. 5A, 5B and 5C inter alia. A refractor 150 completes the globe 144 and can take the form of any one of the refractors shown in FIGS. 5A, 5B and 5C as desired in order to obtain the cutoff performance and other advantages enumerated herein. The globe 144, even though provided with a reflector that does not transmit light retains daytime appearance during nocturnal operation.

Figure 16:
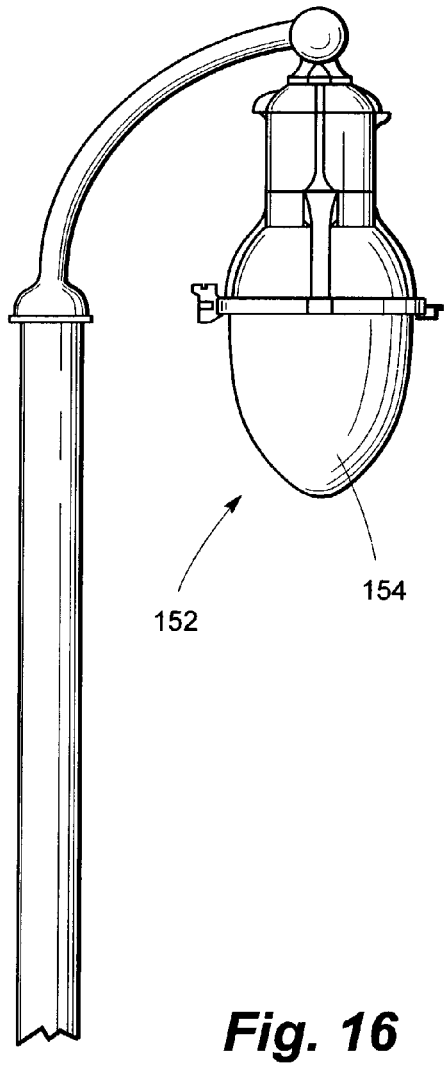

In FIG. 16, a luminaire globe 152 configured according to the invention is mounted in a suspended use environment rather than in the pole-mounted environments intended for use of the globes explicitly described hereinabove. In the suspended arrangement, such as through mounting to an arm of a stanchion or the like, a reflector 154 of the globe 152 is open at upper portions thereof to receive conventional mounting structure not explicitly shown for simplicity as is known in the art. Although not expressly shown in FIG. 16, an optical assembly configured as described herein is mounted interiorly of the globe 152 and provides in association with a refractor 156 a desired cutoff and other advantages detailed herein.

The optical assemblies disclosed herein can be employed to meet I.E.S. semicutoff criteria, these criteria requiring that light intensity be restricted to under 20 percent at a vertical angle of 80° above nadir at any lateral angle about the luminaire and under 5 percent at a horizontal angle of 90° above nadir at any lateral angle about the luminaire. The percentages thus noted are understood to be ratios of intensity to lamp lumens. With reference to the embodiment of FIG. 1 inter alia, said semicutoff criteria can be achieved by the lowering of the lamp 20 and the assembly 22 within the globe 10 and further by widening of the opening 42 in the upper reflector 38, the gap 50 being also enlargeable in order to achieve semicutoff as desired. In particular globe configurations, the arc tube of the lamping employed can be positioned at or below the perimetric edges of a corresponding reflector such as the perimetric edges 28 of the lower reflector 24. A lamp such as the lamp 20 can be lowered a greater distance within the globe 10 relative to any lowering of an optical assembly such as the optical assembly 22 to increase the beam from the optical assembly, thus causing the beam from the refractor 14 to also rise, thereby permitting a greater spacing between luminaires. Luminaire efficiency will also increase by virtue of the fact that a greater amount of light from the lower reflector 24 can exit the refractor 14. It is also to be appreciated that an optical assembly can be configured according to the teachings of the invention to meet any set of specifications relating to limitations on vertical angles, that is, to provide essentially any desired cutoff.

Although the inventive concepts disclosed herein are explicitly described in relation to preferred embodiments, it is to be appreciated that the invention can be practiced other than as expressly described herein without departing from the intended scope of the invention. In this regard, it is to be appreciated that the use of different lamps can require particular positioning of said lamps within a given globe in order to achieve a desired cutoff. Further, an at least partially light transmissive material could be used to form any one of the reflector elements disposed internally of any one of the globes. It is also to be appreciated that the luminaires herein disclosed can be fitted with house-side shields for purposes known in the art. Still further, the teachings of the invention extend to configuration of structure capable of achieving any I.E.S. distribution and I.E.S. cutoff including combinations thereof as is desired and within globes of differing conformation and dimension, the invention being defined by the appended claims.

What is claimed is:

1. A luminaire globe formed of a reflector surmounting a refractor and a light source mounted within said globe, the globe substantially enclosing a space, comprising:

means carried by the globe and within said space for restricting intensities of light emanating from the light source at critical angles, the restricting means comprising a first reflector disposed within the interior of the globe and surrounding and encompassing the light source to shield a light center of the light source for redirection of light having intensities above predetermined cutoff criteria below said critical angles; and, means carried by the globe and within said space for controlling light emanating from the light source in directions essentially upward through the globe.

2. The luminaire globe of claim 1 wherein the reflector and the refractor are formed of light-transmissive materials and have prismatic structures formed on surfaces thereof.

3. The luminaire globe of claim 2 wherein the refractor is selected from the group consisting of a Type II refractor, a Type III refractor or a Type V refractor.

4. The luminaire globe of claim 1 wherein at least a portion of the first reflector has circular contours in a vertical section.

5. The luminaire globe of claim 1 wherein the first reflector has an upper opening formed therein.

6. The luminaire globe of claim 5 wherein the controlling means comprises a second reflector disposed within the interior of the globe and surmounting the first reflector, the second reflector reducing the light incident thereon to limit the amount of light incident on the reflector which forms a portion of the globe and which functions in concert with the refraction to enclose the space.

7. The luminaire globe of claim 6 wherein the second reflector has an opening formed in an upper portion thereof.

8. The luminaire globe of claim 7 wherein the openings formed respectively in the first and second reflectors are aligned.

9. The luminaire globe of claim 8 and further comprising a plate element disposed between the first and second reflectors, the plate element having an opening formed therein, portions of the plate element about the opening formed in the plate element extending between the first and second reflectors.

10. The luminaire globe of claim 9 wherein the opening formed in the plate element is aligned with the aligned openings formed in the first and second reflectors.

11. The luminaire globe of claim 9 wherein the first reflector is spaced from the plate element.

12. The luminaire globe of claim 9 wherein upper portions of the first reflector are contiguous with the plate element.

13. The luminaire globe of claim 1 wherein the reflector is formed of a material that is at least partially non-transmissive of light.

14. The luminaire globe of claim 1 wherein the internal reflector is parabolic.

15. The luminaire globe of claim 14 and further comprising a reflective cover removably mounted to upper portions of the internal reflector.

16. The luminaire globe of claim 1 and further comprising means for mounting the globe through connection to lower portions of the refractor.

17. The luminaire globe of claim 1 and further comprising means for mounting the globe through connection to upper portions of the reflector.

18. The luminaire globe of claim 1 wherein the light source comprises a vertically oriented lamp.

19. A luminaire globe formed of a reflector surmounting a refractor and a light source mounted within said globe, the globe substantially enclosing a space comprising:

means disposed internally of the globe and within said space for reflecting light to at least portions of the refractor at angles similar to angles of that light incident on said portions of the refractor and emanating directly from the light source, the reflecting means comprising a first reflector disposed within the interior of the globe and surrounding and encompassing the light source to shield a light center of the light source for redirection of light having intensities above predetermined cutoff criteria below said critical angles;

means for mounting the reflecting means within the globe; and, means carried by the globe for reducing light emanating essentially upwardly through the globe.

20. The luminaire globe of claim 9 wherein the light source comprises a vertically oriented lamp.

21. The luminaire globe of claim 9 wherein the reflector and the refractor are formed of light transmissive material and have prismatic structures formed on surfaces thereof.

22. The luminaire globe of claim 9 wherein the refractor is selected from the group consisting of a Type II refractor, a Type III refractor or a Type V refractor.

23. The luminaire globe of claim 9 wherein at least a portion of the first reflector has circular contours in a vertical section.

24. The luminaire globe of claim 9 wherein the first reflector has an upper opening formed therein.

25. The luminaire globe of claim 24 wherein the light reducing means comprises a second reflector disposed within the interior of the globe and surmounting the first reflector, the second reflector reducing the light incident thereon to limit the amount of light incident on the reflector.

26. The luminaire globe of claim 25 wherein the second reflector has an opening formed in an upper portion thereof.

27. The luminaire globe of claim 26 wherein the openings formed respectively in the first and second reflectors are aligned.

28. The luminaire globe of claim 27 and further comprising a plate element disposed between the first and second reflectors, the plate element having an opening formed therein, portions of the plate element about said opening formed therein extending between the first and second reflectors.

29. The luminaire globe of claim 28 wherein the opening formed in the plate element is aligned with the aligned openings formed in the first and second reflectors.

30. The luminaire globe of claim 28 wherein the first reflector is spaced from the plate element.

31. The luminaire globe of claim 28 wherein upper portions of the first reflector are contiguous with the plate element.

32. The luminaire globe of claim 27 wherein the reflector is formed of a material that is at least partially non-transmissive of light.

33. The luminaire globe of claim 27 and further comprising means for mounting the globe through connection to lower portions of the refractor.

34. The luminaire globe of claim 27 and further comprising means for mounting the globe through connection to upper portions of the reflector.

35. The luminaire globe of claim 19 and further comprising means for mounting the globe, said globe mounting means having at least portions thereof disposed within the globe, said portions having relatively non-reflective surfaces.

36. The luminaire globe of claim 19 wherein a light center of the light source is disposed in proximity to upper portions of the reflecting means.

37. The luminaire globe of claim 36 wherein the reflecting means comprise an internal reflector disposed within said space and internally of the globe.

38. A luminaire globe formed of a reflector surmounting a refractor and a light source mounted within said globe, the globe substantially enclosing a space, comprising:

means disposed internally of the globe and within said space for reflecting light to at least portions of the refractor at angles similar to angles of that light incident on said portions of the refractor and emanating directly from the light source, the reflecting means comprising an internal reflector disposed within the interior of the globe and surrounding and encompassing the light source to shield a light center of the light source for redirection of light having intensities above predetermined cutoff criteria below said critical angles; and, means for mounting the reflecting means within the globe.

39. The luminaire globe of claim 38 wherein at least a portion of the internal reflector has parabolic contours in a vertical section.

40. The luminaire globe of claim 39 and further comprising a reflective cover removably mounted to upper portions of the internal reflector.

41. A luminaire globe having a reflector surmounting a refractor and a light source mounted within said globe, comprising:

means carried by the globe for restricting intensities of light emanating from the light source at critical angles, said means comprising a first reflector disposed within the interior of the globe and surrounding and encompassing the light source to shield a light center of the light source for redirection of light having intensities above predetermined cutoff criteria below said critical angles, the first reflector having an upper opening formed therein; and, means carried by the globe for controlling light emanating from the light source in directions essentially upward through the globe, said means comprising a second reflector disposed within the interior of the globe and surmounting the first reflector, the second reflector reducing the light incident thereon to limit the amount of light incident on the reflector.

42. The luminaire globe of claim 41 wherein the reflector and the refractor are formed of light-transmissive materials and have prismatic structures formed on surfaces thereof.

43. The luminaire globe of claim 41 wherein the second reflector has an opening formed in an upper portion thereof.

44. The luminaire globe of claim 43 wherein the openings formed respectively in the first and second reflectors are aligned.

45. The luminaire globe of claim 44 and further comprising a plate element disposed between the first and second reflectors, the plate element having an opening formed therein, portions of the plate element about the opening formed in the plate element extending between the first and second reflectors.

46. The luminaire globe of claim 45 wherein the opening formed in the plate element is aligned with the aligned openings formed in the first and second reflectors.

47. The luminaire globe of claim 45 wherein the first reflector is spaced from the plate elelment.

48. The luminaire globe of claim 45 wherein upper portions of the first reflector are contiguous with the plate element.

49. The luminaire globe of claim 42 wherein the restricting means comprises a first reflector disposed within the interior of the globe and surrounding and encompassing the light source to shield a light center of the light source for redirection of light having intensities above predetermined cutoff criteria below said critical angles.

50. The luminaire globe of claim 41 wherein the reflector is formed of a material that is at least partially non-transmissive of light.

51. The luminaire globe of claim 41 wherein the first mentioned means comprises an internal reflector disposed within the interior of the globe and surrounding and encompassing the light source to shield a light center of the light source for redirection of light having intensities above predetermined cutoff criteria below said critical angles.

52. The luminaire globe of claim 51 wherein the internal reflector is parabolic.

53. A luminaire globe formed of a reflector surmounting a refractor and a light source mounted within said globe, the globe substantially enclosing a space, comprising:

means disposed internally of the globe and within said space for reflecting light to at least portions of the refractor at angles similar to angles of that light incident on said portions of the refractor and emanating directly from the light source, a center of the light source being disposed in proximity to upper portions of the reflecting means; and, means for mounting the reflecting means within the globe.

54. The luminaire globe of claim 53 wherein the luminaire globe at lateral angles about the globe exhibits light distributions having intensities for a given value of lamp lumens that is less than 2.5 percent at a horizontal angle of 90° above nadir and 10 percent at a vertical angle of 80° above nadir.

55. The luminaire globe of claim 53 wherein the luminaire globe at lateral angles about the globe exhibits light distributions having intensities for a given value of lamp lumens that is less than 5 percent at a horizontal angle of 90° above nadir and 20 percent at a vertical angle of 80° above nadir.

56. The luminaire globe of claim 53 wherein the reflecting means comprise an internal reflector disposed within said space and internally of the globe.

57. A luminaire globe having a reflector surmounting a refractor and a light source mounted within said globe, comprising:

means for reflecting light to at least portions of the refractor at angles similar to angles of that light incident on said portions of the refractor and emanating directly from the light source, said means comprising an internal reflector disposed within the interior of the globe and surrounding and encompassing the light source to shield a light center of the light source for redirection of light having intensities above predetermined cutoff criteria below said critical angles, at least a portion of the internal reflector having parabolic contours in section;

means for mounting the reflecting means within the globe; and, a reflective cover removably mounted to upper portions of the internal reflector.

58. A luminaire globe having a reflector surmounting a refractor and a light source mounted within said globe, comprising:

means carried by the globe for restricting intensities of light emanating from the light source at critical angles, said means comprising an internal reflector disposed within the interior of the globe and surrounding and encompassing the light source to shield a light center of the light source for redirection of light having intensities above a predetermined cutoff criteria below said critical angles, the internal reflector being parabolic; and, a reflective cover movably mounted to upper portions of the internal reflector.

59. A luminaire globe having a reflector surmounting a refractor and a light source mounted within said globe, comprising:

means for reflecting light to at least portions of the refractor at angles similar to angles of that light incident on said portions of the refractor and emanating directly from the light source, said means comprising a first reflector disposed within the interior of the globe and surrounding and encompassing the light source to shield a light center of the light source for redirection of light having intensities above predetermined cutoff criteria below critical angles;

means for mounting the reflecting means within the globe; and, means carried by the globe for reducing light emanating upwardly through the globe, the reflector and the refractor being formed of light transmissive material and having prismatic structures formed on surfaces thereof.

60. The luminaire globe of claim 59 wherein the first reflector has an upper opening formed therein.

61. The luminaire globe of claim 59 wherein the light reducing means comprises a second reflector disposed within the interior of the globe and surmounting the first reflector, the second reflector reducing the light incident thereon to limit the amount of light incident on the reflector.

62. The luminaire globe of claim 60 wherein the light reducing means comprises a second reflector disposed within the interior of the globe and surmounting the first reflector, the second reflector reducing the light incident thereon to limit the amount of light incident on the reflector.

63. The luminaire globe of claim 61 wherein the second reflector has an opening formed in an upper portion thereof.

64. The luminaire globe of claim 63 wherein the openings formed respectively in the first and second reflectors are aligned.

65. The luminaire globe of claim 64 and further comprising a plate element disposed between the first and second reflectors, the plate element having an opening formed therein, portions of the plate element about said opening formed therein extending between the first and second reflectors.

66. The luminaire globe of claim 65 wherein the opening formed in the plate element is aligned with the aligned openings formed in the first and second reflectors.

67. The luminaire globe of claim 65 wherein the first reflector is spaced from the plate element.

68. The luminaire globe of claim 65 wherein upper portions of the first reflector are contiguous with the plate element.

* * * * *